252-99 AU 157 EX
3/5/85 XR 4,502,986

United States Patent [19]

Robson

[11] Patent Number: 4,502,986

[45] Date of Patent: Mar. 5, 1985

[54] STAIN REMOVAL METHOD USING GRANULAR DETERGENT COMPOSITION COMPRISING MAGNESIUM SALT

[75] Inventor: Peter Robson, Newcastle upon Tyne

[73] Assignee: The Procter & Gamble Company, Cincinnati, Ohio

[21] Appl. No.: 630,996

[22] Filed: Jul. 13, 1984

Related U.S. Application Data

[63] Continuation of Ser. No. 517,479, Jul. 26, 1983, abandoned, which is a continuation of Ser. No. 260,247, May 5, 1981, abandoned.

[30] Foreign Application Priority Data

May 10, 1980 [GB] United Kingdom ..... 8015542

[51] Int. Cl.[3] ..... C11D 1/18; C11D 3/26; C11D 7/32

[52] U.S. Cl. ..... 252/526; 252/99; 252/100; 252/174.16; 252/546

[58] Field of Search ..... 252/526, 99, 100, 174.16, 252/546

[56] References Cited

U.S. PATENT DOCUMENTS 3,714,050 1/1923 Gray ..... 252/99

FOREIGN PATENT DOCUMENTS 1252298 11/1971 United Kingdom .

*Primary Examiner*—John E. Kittle
*Assistant Examiner*—Mukund J. Shah

[57] ABSTRACT

Built granular detergent compositions containing from 0.015% to 0.2%, based on weight of magnesium, of a water-soluble magnesium salt and 0.05% to 0.4% (acid basis) of ethylenediaminetetra(methylene phosphonic acid), diethylenetriamine penta(methylene phosphonic acid) or water-soluble salts thereof. The compositions deliver improved detergency at low wash temperatures.

5 Claims, No Drawings

STAIN REMOVAL METHOD USING GRANULAR DETERGENT COMPOSITION COMPRISING MAGNESIUM SALT

This is a continuation of Ser. No. 517,479 filed July 26, 1983 now abandoned which in turn is a continuation of Ser. No. 260,247 filed May 5, 1981 now abandoned.

TECHNICAL FIELD

This invention relates to granular detergent compositions. In particular it relates to spray-dried detergent compositions for fabric washing purposes having improved detergency under cool-water wash conditions.

BACKGROUND

An important trend in consumer washing practices in recent years has been the move towards machine washing of clothes and other household articles at lower wash temperatures, i.e. less than about 30° C. This has been occasioned both by the increased usage of coloured synthetic articles which may be adversely affected by prolonged washing at high temperatures, and also by energy conservation and other economic conditions. In turn, the trend towards low temperature washing has necessitated improvement in the detergency characteristics of washing machine compositions, particularly in the area of stain removal of bleachable-type stains such as tea, coffee, wine etc. Thus, it is well-known that improvements in bleachable stain removal performance at low wash temperatures are particularly difficult to effect because conventional peroxy bleach additives have only a limited solubility in water in this temperature region and ideally require boil conditions for optimum performance.

It has now been discovered, however, that the overall detergency performance and especially the stain removal performance, of conventional, granular, heavy-duty detergent compositions can be significantly improved at temperatures of 30° C. and below by the use of a specified low level of water soluble magnesium salt, and particularly by the combined use of the water-soluble magnesium salt with certain aminopolyphosphonic acid materials, preferably when used together with a specific magnesium insensitive surfactant system. It is, of course, well-known to add magnesium compounds, and especially magnesium silicate, to bleach-containing detergent compositions at levels of about 2% or more in order to improve the stability of the bleach or in order to minimise interactions between bleach and other components such as enzymes. British Pat. No. 1,252,298 is representative of this approach. Such detergent compositions are characterized by having improved bleachable stain removal performance under boil-wash conditions where degradation of the bleach by, for instance, transition metal impurities is often a significant problem. U.S. Pat. No. 3,714,050, on the other hand, describes the use of high levels of magnesium sulfate for improving the storage stability of formulations containing bleach and enzyme.

There has apparently been no realization in the art, however, of the beneficial detergency and stain removal effects which can be obtained at very low wash temperatures, where peroxy bleaches are substantially inoperative, by the use of low levels of water-soluble magnesium salts in combination with low levels of aminopolyphosphonic acid materials, preferably together with magnesium-insensitive surfactant systems. The selection of the magnesium level is apparently of key importance because the addition of a soluble magnesium salt effectively adds hardness ions to the wash solution and, if added in conventional amounts, this can lead to a loss rather than an improvement in detergency performance, particularly in the areas of clay-soil removal and whiteness maintenance.

The present invention thus provides a detergent composition having improved detergency performance at low wash temperatures, particularly on bleachable-type stains and which delivers excellent cleaning results across the range of hardness and usage conditions without detriment to performance in the areas of particulate soil removal and whiteness maintenance.

SUMMARY OF THE INVENTION

Accordingly, the present invention provides a granular detergent composition characterized by:

(a) from 5% to 30% of surfactant selected from anionic and ethoxylated nonionic surfactants and mixtures thereof, (b) from 5% to 90% of inorganic or organic detergency builder, (c) from 0.015% to 0.20%, based on weight of magnesium, of water-soluble magnesium salt, and (d) from 0.05% to 0.4%, based on the weight of aminopolyphosphonic acid, of ethylenediamine tetra(methylenephosphonic acid), diethylene-triamine penta(methylene phosphonic acid), or water-soluble salts thereof.

Preferably, the compositions of the invention contain from about 0.05% to about 0.12%, more preferably from about 0.05% to about 0.09% based on weight of magnesium, of the water soluble magnesium salt which can be selected from magnesium sulfate, magnesium chloride and the hydrates thereof.

In preferred embodiments, the surfactant is selected from ethoxylated surfactants and mixtures thereof with synthetic anionic surfactants in a weight ratio of at least about 1:1. Anionic soap materials can also be added but preferably in minor amounts. Suitable compositions of this type comprise ethoxylated surfactants and synthetic anionic surfactants as described above, but in addition contain anionic soaps in a weight ratio of synthetic anionic surfactant to anionic soap, of at least about 1:1, preferably at least about 55:45.

Highly preferred nonionic surfactants are condensation products of $C_{9-15}$ fatty alcohols with an average of about 2 to about 12 moles of ethylene oxide and these are desirably used in admixture with anionic surfactant in a weight ratio of about 8:1 to about 5:4. The total level of surfactant is preferably from about 8% to about 20%, especially from about 10% to about 15% by weight of the composition.

In highly preferred embodiments, there is added from about 0.05% to about 0.25% by weight of amino polyphosphonic acid selected from ethylene diamine tetra(methylene phosphonic acid), diethylenetriaminepenta(methylene phosphonic acid) or alkali metal or ammonium salts thereof, the weight percentages being specified on the basis of the corresponding amino polyphosphonic acid. The combination of water-soluble magnesium salt and the amino polyphosphonic acid is particularly valuable in enhancing the low temperature detergency characteristics of the composition, the two materials apparently co-acting to improve stain removal at low temperatures without deleteriously affecting the stain removal performance of the composition at the boil.

A suitable process of making the detergent compositions of the invention includes the steps of forming an aqueous slurry comprising detergency builder, water-soluble magnesium salt and, where present, anionic surfactant, spray drying the aqueous slurry to form a detergent base granule and dispersing the ethoxylated nonionic surfactant, for instance by spraying, onto the detergent base granule. The aminopolyphosphonic acid material can be incorporated as a separate additive, but preferably is incorporated in the aqueous slurry for spray drying. The optional sulfate and silicate components are preferably also included in the aqueous slurry but bleach and enzyme components are generally added as separate admixtures.

The various essential and optional components of the invention will now be discussed in more detail.

A wide range of ethoxylated nonionic and anionic surfactants can be used in the present compositions. A typical listing of the classes and species of these surfactants is given in U.S. Pat. No. 3,663,961 issued to Norris on May 23, 1972 and incorporated herein by reference. Synthetic anionic surfactants, if present, are preferably added in a weight ratio of nonionic surfactant:anionic surfactant of at least about 1:1 however. Moreover, anionic soaps, if present, are also preferably added in a weight ratio of synthetic anionic surfactant:anionic soap of at least about 1:1. In highly preferred compositions, however, anionic soaps are excluded.

Suitable synthetic anionic surfactants are water-soluble salts of alkyl benzene sulfonates, alkyl sulfates, alkyl polyethoxy ether sulfates, paraffin sulfonates, alpha-olefin sulfonates, alpha-sulfocarboxylates and their esters, alkyl glyceryl ether sulfonates, fatty acid monoglyceride sulfates and sulfonates, alkyl phenol polyethoxy ether sulfates, 2-acyloxy-alkane-1-sulfonate, and beta-alkyloxy alkane sulfonate.

A particularly suitable class of anionic detergents includes water-soluble salts, particularly the alkali metal, ammonium and alkanolammonium salts of organic sulfuric reaction products having in their molecular structure an alkyl or alkaryl group containing from about 8 to about 22, especially from about 10 to about 20 carbon atoms and a sulfonic acid or sulfuric acid ester group. (Included in the term "alkyl" is the alkyl portion of acyl groups). Examples of this group of synthetic detergents which form part of the detergent compositions of the present invention are the sodium and potassium alkyl sulfates, especially those obtained by sulfating the higher alcohols ($C_8$–$C_{18}$) carbon atoms produced by reducing the glycerides of tallow or coconut oil and sodium and potassium alkyl benzene sulfonates, in which the alkyl group contains from about 9 to about 15, especially about 11 to about 13, carbon atoms, in straight chain or branched chain configuration, e.g. those of the type described in U.S. Pat. Nos. 2,220,099 and 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulfonates in which the average of the alkyl group is about 11.8 carbon atoms, abbreviated as $C_{11.8}$LAS.

Other anionic detergent compounds herein include the sodium $C_{10}$–$C_{18}$ alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic detergent compounds herein include the water-soluble salts or esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 18, especially about 12 to 16, carbon atoms in the alkyl group and from about 1 to 12, especially 1 to 6, more especially 1 to 4 moles of ethylene oxide; water-soluble salts of olefin sulfonates containing from about 12 to 24, preferably about 14 to 16, carbon atoms, especially those made by reaction with sulfur trioxide followed by neutralization under conditions such that any sultones present are hydrolysed to the corresponding hydroxy alkane sulfonates; water-soluble salts of paraffin sulfonates containing from about 8 to 24, especially 14 to 18 carbon atoms, and β-alkyloxy alkane sulfonates containing from about 1 to 3 carbon atoms in the alkyl group and from about 8 to 20 carbon atoms in the alkane moeity.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred. Mixtures of anionic surfactants are contemplated by this invention; a preferred mixture contains alkyl benzene sulfonate having 11 to 13 carbon atoms in the alkyl group or paraffin sulfonate having 14 to 18 carbon atoms and either an alkyl sulfate having 8 to 18, preferably 12 to 18, carbon atoms in the alkyl group, or an alkyl polyethoxy alcohol sulfate having 10 to 16 carbon atoms in the alkyl group and an average degree of ethoxylation of 1 to 6.

Water-soluble salts of the higher fatty acids, i.e. "soaps", can also be included in the compositions of the invention. This class of detergents includes ordinary alkali metal soaps such as the sodium, potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixture of fatty acids derived from coconut oil and tallow i.e. sodium or potassium tallow and coconut soap.

Ethoxylated nonionic surfactant materials can be broadly defined as compounds produced by the condensation of ethylene oxide groups (hydrophilic in nature) with an organic hydrophobic compound, which may be aliphatic or alkyl aromatic in nature. The length of the polyoxyethylene group which is condensed with any particular hydrophobic group can be readily adjusted to yield a water-soluble compound having the desired degree of balance between hydrophilic and hydrophobic elements.

Examples of suitable nonionic surfactants include:

1. The polyethylene oxide condensates of alkyl phenol, e.g. the condensation products of alkyl phenols having an alkyl group containing from 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl subtituent in such compounds may be derived, for example, from polymerised propylene, di-isobutylene, octene and nonene. Other examples include dodecylphenol condensed with 12 moles of ethylene oxide per mole of phenol; dinonylphenol condensed with 15 moles of ethylene oxide per mole of phenol; nonylphenol and di-isoisooctylphenol condensed with 15 moles of ethylene oxide.

2. The condensation product of primary or secondary aliphatic alcohols having from 8 to 24 carbon atoms, in either straight chain or branched chain configuration, with from 1 to about 30 moles of alkylene oxide per mole of alcohol. Preferably, the aliphatic alcohol comprises between 9 and 15 carbon atoms and is ethoxylated with between 2 and 12, desirably between 3 and 9 moles of ethylene oxide per mole of aliphatic alcohol. Such nonionic surfactants are preferred from the point of view of providing good to excellent detergency performance on fatty and greasy soils, and in the presence of hardness sensitive anionic surfactants such as alkyl benzene sulfonates. The preferred surfactants are prepared from primary alcohols which are either linear (such as those derived from natural fats or, prepared by the Ziegler process from ethylene, e.g. myristyl, cetyl, stearyl alcohols), or partly branched such as the Dobanols and Neodols which have about 25% 2-methyl branching (Dobanol and Neodol being Trade Names of Shell) or Synperonics, which are understood to have about 50% 2-methyl branching (Synperonic is a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-9, Dobanol 91-3, Dobanol 91-6, Dobanol 91-8, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

3. The compounds formed by condensing ethylene oxide with a hydrophobic base formed by the condensation of propylene oxide with either propylene glycol or ethylene diamine. Such synthetic nonionic detergents are available on the market under the Trade Names of "Pluronic" and "Tetronic" respectively supplied by Wyandotte Chemicals Corporation.

Of the above, highly preferred are alkoxylated nonionic surfactants having an average HLB in the range from about 9.5 to 13.5, especially 10 to 12.5. Highly suitable nonionic surfactants of this type are ethoxylated primary or secondary $C_{9-15}$ alcohols having an average degree of ethoxylation from about 3 to 9, more preferably from about 5 to 8.

In addition to the above anionic and ethoxylated nonionic surfactants, the composition of the invention can also contain minor proportions of amphoteric, zwitterionic or cationic surfactants. Suitable ampholytic surfactants are water-soluble derivatives of aliphatic secondary and tertiary amines in which the aliphatic moiety can be straight chain or branched and wherein one of the aliphatic substituents contains from about 8 to 18 carbon atoms and one contains an anionic water-solubilizing group, e.g. carboxy, sulfonate, sulfate, phosphate, or phosphonate.

Suitable zwitterionic surfactants are water soluble derivatives of aliphatic quaternary ammonium, phosphonium and sulfonium cationic compounds in which the aliphatic moieties can be straight chain or branched, and wherein one of the aliphatic substituents contains from about 8 to 18 carbon atoms and one contains an anionic water-solubilizing group.

A preferred group of cationic surfactants have the general formula:

$$R^1{}_mR^2{}_{4-m}NZ$$

wherein $R^1$ is selected from $C_{8-20}$ alkyl, alkenyl and alkaryl groups; $R^2$ is selected from $C_{1-4}$ alkyl and benzyl groups; Z is an anion in number to give electrical neutrality; and m is 1, 2 or 3; provided that when m is 2, $R^1$ has less than 15 carbon atoms and when m is 3, $R^1$ has less than 9 carbon atoms.

Where m is equal to 1, it is preferred that $R^2$ is a methyl group. Preferred compositions of this monolong chain type include those in which $R^1$ is $C_{10}$ to $C_{16}$ alkyl group. Particularly preferred compositions of this class include $C_{12}$ alkyl trimethylammonium halide and $C_{14}$ alkyl trimethylammonium halide.

Where m is equal to 2, the $R^1$ chains should have less than 14 carbon atoms. Particularly preferred cationic materials of this class include di-$C_8$ alkyldimethylammonium halide and di-$C_{10}$ alkyldimethylammonium halide materials.

Where m is equal to 3, the $R^1$ chains should be less than 9 carbon atoms in length. An example is trioctyl methyl ammonium chloride.

The compositions of the invention also contain from about 5% to about 90% of detergency builder, preferably from about 20% to about 80% thereof.

Suitable detergent builder salts useful herein can be of the polyvalent inorganic and polyvalent organic, especially polycarboxylate types, and water-insoluble aluminosilicate types or mixtures thereof. Non-limiting examples of suitable water-soluble, inorganic alkaline detergent builder salts include the alkali metal carbonates, borates, phosphates, pyrophosphates, tripolyphosphates and bicarbonates.

Examples of suitable organic alkaline detergency builder salts are:

(1) water-soluble amino polyacetates, e.g., sodium and potassium ethylenediaminetetraacetates, nitrilotriacetates, and N-(2-hydroxyethyl)nitrilodiacetates;

(2) water-soluble salts of phytic acid, e.g. sodium and potassium phytates;

(3) water-soluble polyphosphonates, including, sodium, potassium and lithium salts of ethane-1-hydroxy-1,1-diphosphonic acid; sodium, potassium and lithium salts of methylenediphosphonic acid and the like.

(4) water-soluble polycarboxylates such as the salts of lactic acid, glycollic acid and ether derivatives thereof as disclosed in Belgian Pat. Nos. 821,368, 821,369 and 821,370; succinic acid, malonic acid, (ethylenedioxy) diacetic acid, maleic acid, diglycollic acid, tartaric acid, tartronic acid and fumaric acid; citric acid, aconitic acid, citraconic acid, carboxymethyloxysuccinic acid, lactoxysuccinic acid, and 2-oxa-1,1,3-propane tricarboxylic acid; oxydisuccinic acid, 1,1,2,2-ethane tetracarboxylic acid, 1,1,3,3-propane tetracarboxylic acid and 1,1,2,3-propane tetracarboxylic acid; cyclopentane-cis, cis, cis-tetracarboxylic acid, cyclopentadienide pentacarboxylic acid, 2,3,4,5-tetrahydrofuran-cis, cis, cis-tetracarboxylic acid, 2,5-tetrahydrofuran-cis-dicarboxylic acid, 1,2,3,4,5,6-hexane-hexacarboxylic acid, mellitic acid, pyromellitic acid and the phthalic acid derivatives disclosed in British Pat. No. 1,425,343.

Mixtures of organic and/or inorganic builders can be used herein. One such mixture of builders is disclosed in Canadian Pat. No. 755,038, e.g. a ternary mixture of sodium tripolyphosphate, trisodium nitrilotriacetate, and trisodium ethane-1-hydroxy-1,1-diphosphonate.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of British Patent Specification No. 1,429,143 published Mar. 24, 1976, German Patent Application Nos. OLS 2,433,485 published Feb. 6, 1975, and OLS 2,525,778 published Jan. 2, 1976, the disclosures of which are incorporated herein by reference.

Another essential component of the present compositions is a water-soluble magnesium salt which is added at levels such as to provide a magnesium content in the range from about 0.015% to about 0.2%, more preferably from about 0.05% to about 0.12% and especially from about 0.05% to about 0.09% by weight of the compositions. Suitable magnesium salts include magnesium sulfate, magnesium sulfate heptahydrate, magnesium chloride, magnesium chloride hexahydrate, magnesium nitrate and magnesium acetate. By water-soluble is meant that the salt has a solubility in distilled water at 25° C. of at least about 2% by weight (i.e. 2 g/100 g solution). Water-insoluble salts such as magnesium silicate are not beneficial in the instant compositions. Desirably, the magnesium salt is added to the compositions as part of the aqueous slurry crutcher mix and is then converted to dry granular form, for instance by spray drying. The builder and, where present, the anionic surfactant are present in the crutcher mix. It will be understood that some or all of the magnesium introduced into the aqueous slurry may be converted to other salts and other species based on magnesium during the mixing and spraying operations.

The aminopolyphosphonate component of the present compositions is selected from ethylenediaminetetra(methylene phosphonic acid), diethylenetriamine penta(methylene phosphonic acid) and water-soluble salts thereof, especially alkali metal or ammonium. The amino polyphosphonate is preferably included at a level in the range from about 0.05% to 0.4%, more preferably from about 0.05% to 0.25% by weight of the composition. The aminopolyphosphonate is preferably included in the aqueous slurry crutcher mix for spray-drying, but it can also be incorporated as a separate granular admixture, either by itself or as part of an auxiliary additive composition.

The compositions of the present invention can be supplemented by all manner of detergent components, either by including such components in the aqueous slurry to be dried or by admixing such components with the compositions of the invention following the drying step. Soil-suspending agents at about 0.1% to 10% by weight such as water-soluble salts of carboxymethylcellulose, carboxyhydroxymethyl cellulose, and polyethylene glycols having a molecular weight of about 400 to 10,000 are common components of the present invention. Dyes, pigment optical brighteners, and perfumes can be added in varying amounts as desired.

Other materials such as fluorescers, enzymes in minor amounts, anti-caking agents such as sodium sulfo-succinate, and sodium benzoate can also be added. Enzymes suitable for use herein include those discussed in U.S. Pat. No. 3,519,570 and 3,533,139 to McCarty and McCarty et al issued July 7, 1970 and Jan. 5, 1971, respectively.

Anionic fluorescent brightening agents are well-known materials, examples of which are disodium 4,4'-bis-(2-diethanolamino-4-anilino-s-triazin-6-ylamino)stilbene-2:2'disulphonate, disodium 4,4'-bis-(2-morpholino-4-anilino-s-triazin-6-ylaminostilbene-2:2'-disulphonate,-disodium 4,4'-bis-(2,4-dianilino-s-triazin-6-ylamino)stilbene-2:2'-disulphonate, disodium 4,4'-bis-(2-anilino-4-(N-methyl-N-2-hydroxyethylamino)-s-triazin-6-ylamino)stilbene-2,2'-disulphonate, disodium 4,4'-bis-(4-phenyl-2,1,3-triazol-2-yl)-stilbene-2,2'-disulphonate, disodium 4,4'-bis(2-anilino-4-(1-methyl-2-hydroxyethylamino)-s-triazin-6-ylamino)stilbene-2,2'-disulphonate and sodium 2(stilbyl-4''-(naphtho-1',2':4,5)-1,2,3-triazole-2''-sulphonate.

An alkali metal, or alkaline earth metal, silicate can also be present. The alkali metal silicate preferably is used in an amount from about 1% to about 15%, preferably from about 3% to about 8%. Suitable silicate solids have a molar ratio of $SiO_2$/alkali metal$_2$O in the range from about 1.0 to about 3.3, more preferably from 1.5 to 2.0.

Other optional ingredients include suds modifiers particularly those of suds suppressing type, exemplified by silicones, and silica-silicone mixtures.

U.S. Pat. No. 3,933,672 issued Jan. 20, 1976, to Bartollota et al., incorporated herein by reference, discloses a silicone suds controlling agent. The silicone material can be represented by alkylated polysiloxane materials such as silica aerogels and xerogels and hydrophobic silicas of various types. The silicone material can be described as siloxane having the formula:

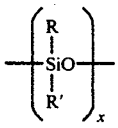

wherein x is from about 20 to about 2,000 and R and R' are each alkyl or aryl groups, especially methyl, ethyl, propyl, butyl and phenyl. The polydimethylsiloxanes (R and R' are methyl) having a molecular weight within the range of from about 200 to about 2,000,000, and higher, are all useful as suds controlling agents. Additional suitable silicone materials wherein the side chain groups R and R' are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpolysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2/g$. intimately admixed with dimethyl silicone fluid having a molecular weight in the range from about 500 to about 200,000 at a weight ratio of silicone to silanated silica of from about 1:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in German Patent Application DTOS No. 2,646,126 published Apr. 28, 1977 and incorporated herein by reference. An example of such a compound is DB-544, commercially available from Dow Corning, which is a siloxane/-glycol copolymer.

Suds modifiers as described above are used at levels of up to approximately 5%, preferably from 0.1 to 2% by weight of the nonionic surfactant. They can be incorporated into the particulates of the present invention or can be formed into separate particulates that can then be mixed with the particulates of the invention. The incorporation of the suds modifiers as separate particulates also permits the inclusion therein of other suds controlling materials such as microcrystalline waxes and high MWt copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Other highly preferred additional components include bleaches which can be added at levels in the range from about 1% to about 35% and can be selected from peroxy salts such as sodium perborate mono- and tetrahydrate, sodium percarbonate, sodium persilicates and sodium perphosphates, peroxyacids such as diperisophthalic acid and diperazelaic acid, and organic peroxyacid precursors such as methyl o-acetoxy benzoate, sodium p-acetoxy benzene sulfonate, Bisphenol A diacetate, tetraacetyl ethylene diamine, tetraacetyl hexamethylene diamine and tetraacetyl methylene diamine. A filler such as an alkali metal sulfate is also a desirable additive, and can be present at levels from about 1% to about 85%, preferably from about 5% to about 30% by weight of the compositions. From about 0.1% to 2% of an aminocarboxylate sequestrant, eg. EDTA, is preferably also included.

In the Examples which follow, the abbreviations used have the following designation:

| | |
|---|---|
| LAS | Linear $C_{11.8}$ alkyl benzene sulphonate. |
| $AE_3S$ | Sodium linear $C_{12-14}$ alcohol sulfate including 3 ethylene oxide moieties. |
| $CnAE_n$ | Coconut alcohol ethoxylated with n moles of ethylene oxide per mole of alcohol. |

-continued

| | |
|---|---|
| Dobanol 45-E-7 | A $C_{14-15}$ oxo-alcohol with 7 moles of ethylene oxide, marketed by Shell. |
| Dobanol 45-E-4 | A $C_{14-15}$ oxo-alcohol with 4 moles of ethylene oxide, marketed by Shell. |
| TAED | Tetraacetyl ethylene diamine. |
| Silicate | Sodium silicate having an $SiO_2$:$Na_2O$ ratio of 1.6. |
| Wax | Microcrystalline wax - Witcodur 272 M.pt 87° C. |
| Silicone Prill | Comprising 0.14 parts by weight of an 85:15 by weight mixture of silanated silica and silicone granulated with 1.3 parts of sodium tripolyphosphate, and 0.56 parts of tallow alcohol condensed with 25 molar proportions of ethylene oxide. |
| Gantrez AN119 | Trade Name for maleic anhydride/vinyl methyl ether copolymer, believed to have an average molecular weight of about 240.000, marketed by GAF. This was prehydrolysed with NaOH before addition. |
| Brightener | Disodium 4,4'-bis(2-morpolino-4-anilino-s-triazin-6-ylamino)stilbene-2:2'-disulphonate. |
| Dequest 2060 | Trade Name for diethylene triamine penta(methylene phosphonic acid), marketed by Monsanto |
| Dequest 2041 | Trade Name for ethylenediamine tetra (methylene phosphonic acid) marketed by Monsanto. |

The present invention is illustrated by the following non-limiting examples:

EXAMPLES I–VI

The following granular detergent compositions are prepared by mixing all ingredients, apart from nonionic surfactant, bleach, silicone prill and enzyme, in a crutcher as an aqueous slurry, spray-drying the slurry at high temperature in a spray-drying tower, admixing bleach silicone prill and enzyme with the spray-dried detergent base powder, and spraying the nonionic surfactant onto the resulting granular mixture.

| | EXAMPLES | | | | | |
|---|---|---|---|---|---|---|
| | I | II | III | IV | V | VI |
| LAS | 4 | 1.5 | — | — | 1.5 | 3.0 |
| $AE_3S$ | — | — | 3 | — | — | — |
| $CnAE_6$ | — | — | 5 | — | 10 | — |
| Dobanol 45-E-7 | 8 | 8 | — | 12 | — | 8.5 |
| Dobanol 45-E-4 | — | 2 | — | 3 | 2 | — |
| TAED | — | 5 | — | 2 | — | — |
| Silicate | 5 | 7 | 10 | 4 | 2 | 6 |
| Wax | 0.6 | — | — | 0.5 | — | 0.4 |
| Silicone Prill | — | 1 | 1.5 | — | 2.0 | — |
| Gantrez AN119 | 0.4 | — | — | 1.5 | — | 0.8 |
| Brightener | 0.2 | 0.1 | 0.5 | 0.3 | 0.5 | 0.2 |
| Dequest 2060 | — | 0.2 | 0.25 | — | 0.1 | — |
| Dequest 2041 | 0.1 | — | — | 0.09 | — | 0.25 |
| EDTA | 0.2 | — | — | 0.1 | — | — |
| Sodium perborate | 24 | 10 | 20 | 25 | 15 | 22 |
| Alcalase enzyme | 0.6 | — | — | 1.2 | — | 0.9 |
| Sodium tripolyphosphate | 33 | 36 | 25 | 35 | 50 | 30 |
| Magnesium sulfate | 0.5 | 0.3 | 0.6 | 0.7 | 0.2 | 0.4 |
| Sodium soap of coconut fatty acid | — | — | — | — | — | 1.5 |
| Sodium sulfate, moisture & miscellaneous | to 100 | | | | | |

Compared with compositions containing no magnesium sulfate or amino polyphosphonic acid, the above compositions deliver improved detergency performance at a 30° C. wash temperature, particularly on bleachable-type stains such as tea, coffee and wine, without detriment to performance in the areas of particulate soil removal, enzymatic and greasy stain removal and whiteness maintenance.

What is claimed is:

1. A method of washing fabric stained with tea or wine stains to remove such stains while maintaining the whiteness of white fabrics in the wash load, said method comprising washing such fabric in a washing machine with an aqueous wash solution of a composition comprising:

(a) from 5% to 30% of surfactant selected from the group consisting of anionic and ethoxylated nonionic surfactants and mixtures thereof, (b) from 5% to 90% of inorganic or organic detergency builder, (c) from 0.015% to 0.12%, based on the weight of magnesium, of water soluble magnesium salt, and (d) from 0.05% to 0.4%, based on the weight of aminopolyphosphonic acid, of ethylenediamine tetra(methylenephosphonic acid), diethylenetriamine penta(methylenephosphonic acid), or water soluble salts thereof.

2. A method as recited in claim 1 wherein such washing is carried out at a temperature of 30° C. or below.

3. A method according to claim 2 wherein the composition comprises from 0.05% to 0.12%, based on the weight magnesium, of the water-soluble magnesium salt.

4. A method according to claim 3 wherein the water-soluble magnesium salt is selected from the group consisting of magnesium sulfate, magnesium chloride and the hydrates thereof.

5. A method according to claim 1 wherein the component (d) is ethylenediamine tetra(methylenephosphonic acid) or water soluble salt thereof.

* * * * *

UNITED STATES PATENT AND TRADEMARK OFFICE

CERTIFICATE OF CORRECTION

PATENT NO. : 4,502,986

DATED : March 5, 1985

INVENTOR(S) : PETER ROBSON

It is certified that error appears in the above—identified patent and that said Letters Patent is hereby corrected as shown below:

The following should additionally be listed as References Cited under U.S. PATENT DOCUMENTS on the cover page:

| | | | |
|---|---|---|---|
| 3,562,168 | 2/1971 | Wetmore et al. | 252/545 |
| 3,985,670 | 10/1976 | Berg et al. | 252/545 |
| 4,239,643 | 12/1980 | Kowalski | 252/526 |
| 4,304,690 | 12/1981 | Schulze et al. | 252/526 |

Signed and Sealed this

*Thirtieth* Day of *July 1985*

[SEAL]

*Attest:*

DONALD J. QUIGG

*Attesting Officer* *Acting Commissioner of Patents and Trademarks*